United States Patent [19]

Swanke et al.

[11] B 3,986,650

[45] Oct. 19, 1976

[54] POSITIONALLY CONSTRAINING WEB SUPPORT

[75] Inventors: Thaddeus Swanke, Rochester; Richard T. O'Marra, Churchville, both of N.Y.

[73] Assignee: Eastman Kodak Company, Rochester, N.Y.

[22] Filed: Sept. 10, 1974

[21] Appl. No.: 504,778

[44] Published under the second Trial Voluntary Protest Program on February 24, 1976 as document No. B 504,778.

[52] U.S. Cl. ..... 226/21; 226/196

[51] Int. Cl.[2] ..... B65H 25/26

[58] Field of Search ..... 226/15, 18, 19, 21, 226/196, 198, 199

[56] References Cited

UNITED STATES PATENTS

| | | | |
|---|---|---|---|
| 3,315,859 | 4/1967 | Owen | 226/21 |
| 3,507,437 | 4/1970 | Lips | 226/192 X |
| 3,598,332 | 8/1971 | Sharkey | 226/196 X |
| 3,658,227 | 4/1972 | Stephens | 226/196 |
| 3,753,517 | 8/1973 | Takenaka | 226/196 X |

*Primary Examiner*—Richard A. Schacher
*Attorney, Agent, or Firm*—G.H. Childress

[57] ABSTRACT

Web support for constraining the entering portion of a moving web against change in its spatial lateral position while remaining free to change its angular lateral position. The web support includes a web engaging surface which presents substantially no lateral resistance to the entering position of the moving web, and opposed edge guides mounted in a predetermined position on a fixed frame adjacent to the web engaging surface. The edge guides have opposed web engaging portions a fixed distance apart which distance corresponds substantially to the width of the moving web.

9 Claims, 4 Drawing Figures

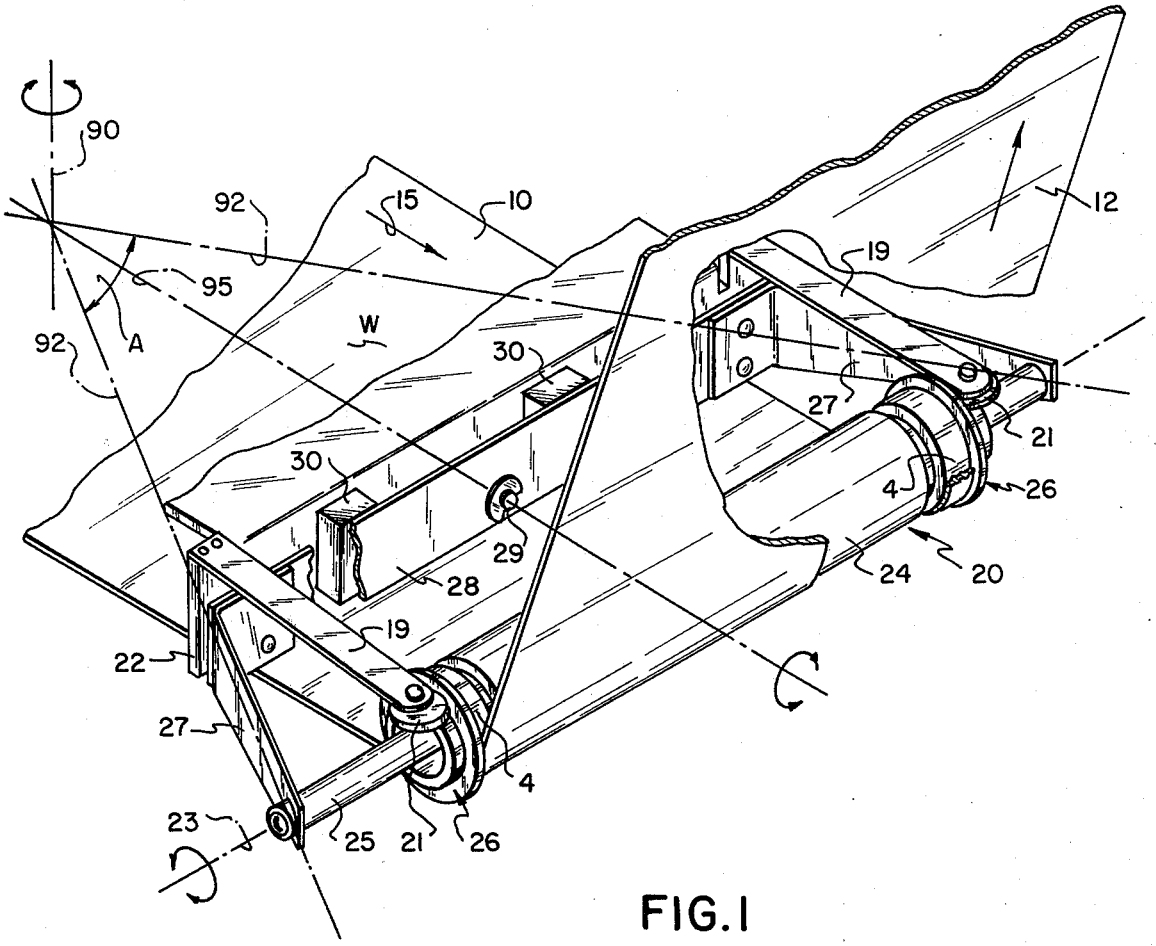
FIG. 1
FIG. 2
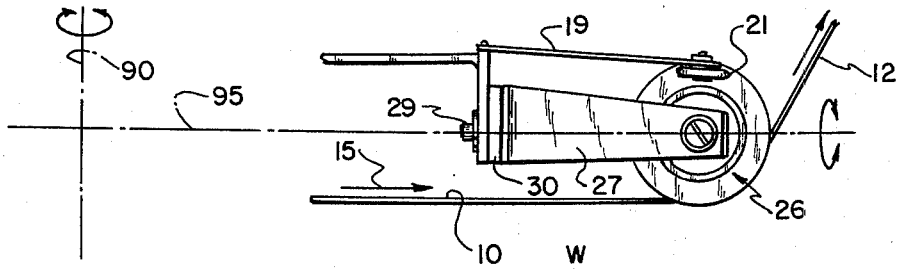

POSITIONALLY CONSTRAINING WEB SUPPORT

CROSS-REFERENCES TO RELATED APPLICATIONS

Reference is hereby made to commonly assigned and copending U.S. patent application Ser. No. 504,771, entitled WEB TRACKING APPARATUS, filed on even data herewith in the names of Thaddeus Swanke, Michael Samuel Montalto, and John Edwin Morse. Reference is also made to commonly assigned and copending U.S. patent application Ser. No. 504,777, entitled WEB SUPPORT WITH CASTERED AND GIMBALLED ROLLER filed on even date herewith, in the name of John Edwin Morse.

BACKGROUND OF THE INVENTION

1. Field of the Invention

This invention relates generally to a web handling device, and more specifically to a laterally constraining web support in which the entering portion of the moving web is constrained against changing its spatial lateral position while remaining free to change its angular lateral position.

2. Description of the Prior Art

Web tracking apparatus for tracking flexible, unidirectionally moving webs on hard surfaced, cylindrical web supports can be considered functionally as comprising basically two types of web supports. The linearly moving web approaching a web support "sees" the support, relative to a fixed frame, either as (1) a laterally constraining support, or (2) a laterally non constraining support. A laterally constraining support may be further subdivided into (a) an angular lateral constraint in which the entering web is constrained against changing its lateral position relative to the frame except as its angular position changes relative to the frame, and (b) a positional lateral constraint in which the entering web is constrained against changing its spatial lateral position relative to the frame, while remaining free to change its angular position. The web entering a non constraining support, on the other hand, is free to change either its angular or its spatial lateral position relative to the frame without experiencing substantial lateral forces.

Whether a particular web support is a laterally constraining or laterally non constraining support depends as much on its function in the tracking apparatus as on its structure. For example, a fixed axis, rotating, cylindrical roller, such as an idler roller or a drive roller in a tracking apparatus is structurally an angular lateral constrain capable of constraint the moving web against change in its lateral position. To perform as an angular lateral constraint, the entering web has to be capable of tracking on the rotating cylindrical surface until the moving web and the rotating surface are in alignment, i.e., until the longitudinal axis of the rotating surface is perpendicular to the direction of travel of the web. This tracking phenomenon is due to frictional forces developed between the linearly moving web and the rotating surface, which in turn are a function of, among other variables, wrap angle, web tension, and the upstream web-span to web-width ratio. Thus, if the wrap angle, for example, is insufficient to create the frictional forces necessary for tracking, the entering web is free to change its angular position and/or its lateral spatial position without experiencing substantial lateral forces, resulting in a web support that is functionally non constraining, although structurally an angular lateral constraint.

Although the above-noted variables upon which tracking depend are usually parameters which are governed by the design of the web tracking apparatus, some generalities can be stated that cover a significant number of situations. Thus, for a flexible web supported by hard surface cylindrical supports, the upstream web-span to web-width ratio should be somewhat equal to or greater than one, and the wrap angle should range between approximately 30° and 135°, depending on the coefficient of friction of the surfaces in contact, and on web tension. If otherwise, the web could be prevented from tracking, either because of not enough, or too much contact with the web support.

To facilitate the discussion to follow, it will be convenient to refer to a lateral non constraining support as an N support, and to refer to a laterally constraining support as a P support if it is functionally a positional lateral constraint, and as an A support if it is functionally an angular lateral constraint.

In designing a closed loop web tracking apparatus of the type discussed above, one of the primary considerations of the design is lateral stability of the linearly moving web. Generally, stability of the linearly moving web is achieved if the tracking apparatus has at least two laterally constraining supports, at least one of which is further restricted to be a P support; the remaining web supports, if any, in the tracking apparatus can be either laterally constraining supports (P and A) or non constraining supports (N) as dictated by design considerations.

Although the stability principle stated above will ensure lateral stability of the moving web, it does not, without more, ensure uniformity of tension in the moving web. Nonuniformity in tension ordinarily results from imperfections in the manufacture of webs and web supports, and from the lack of perfect parallelism in the longitudinal axes of the mounted web supports. It follows that if manufacturing tolerances are minimized and the supports are mounted with a high degree of parallelism, a degree of uniformity of tension will be achieved. However, such considerations are independent of the stability principle.

If a high degree of uniformity of tension of the web is a requisite of the tracking apparatus design, it can be achieved with little regard to manufacturing or mounting tolerances by conforming the web tracking apparatus to what will be referred to as the uniformity of tension principle. This second web tracking principle dictates that the moving web exiting from a first laterally constraining support must be given freedom, once and only once, to change direction before entering a second laterally constraining support. This freedom is given to the exiting web by "gimballing" the web support; i.e., by mounting the web support, whether of the constraining type or of the non constraining type, for pivotal movement about a gimbal axis which is parallel to the direction of linear movement of the entering web, and which intersects the longitudinal axis of the support at the midpoint of the support.

The gimbal action of the web support; i.e., the capability of the exiting web to change direction, enables the exiting web to compensate for non uniformity of tension of the web in the downstream web span. The resultant force of the non uniform tension across the exiting web is at some perpendicular distance from the centerline of the moving web; the component of that resultant force which is perpendicular to the gimbal axis creates a moment about the gimbal axis which varies with the sine of the wrap angle, since the magnitude of the force component perpendicular to the gimbal axis varies with the sine of the wrap angle. For example, for wrap angles approaching zero or 180° the magnitude of the force component approaches zero and therefore, the exiting web is not free to change direction.

It is clear from the above relationship that the magnitude of the force component perpendicular to the gimbal axis is greatest for a wrap angle of 90°; moreover, as the wrap angle increases appreciably from 180° the exiting web behaves as if the wrap angle were appreciably greater than zero. While the gimbal action may not be appreciably inhibited by large wrap angles (e.g., those appreciably less than 180° and especially those appreciably greater than 180°), such large wrap angles may inhibit the tracking action of a web support, thereby possibly producing an unstable tracking apparatus.

The "once and only once" requirement of the uniformity of tension principle can be illustrated by theorizing a tracking apparatus in which the web exiting from a P or A support encounters two N supports before entering a second laterally constraining support. The "once and only once" requirement provides that only one of the three supports, i.e., the first laterally constraining P or A support, the first N support, or the second N support, be gimballed; the other two must prevent the exiting web from changing direction. For reasons noted above, gimballing one of the supports provides uniformity of tension in the downstream web without affecting lateral stability. However, if more than one support is gimballed before the web enters a second lateral constraint, the lateral position of the web at the second and any subsequent non constraining gimballed supports, becomes unstable and indeterminate. The result could be lateral instability of the web span between the first gimballed support and the second constraining web support, and possible edge damage to the moving web due to such instability. Thus, the "once and only once" requirement ensures lateral stability in the moving web when N supports are utilized in a tracking apparatus, while providing uniformity of tension.

Theoretically, the above principles would not be violated by a two-support, closed loop web tracking apparatus. However, technical problems such as the gimballing of a drive roller to meet the "once and only once" requirement, and wrap angle considerations upon which the gimballing action depends, as well as practical problems such as utility for such a two-support apparatus, could make such an apparatus commercially unattractive. On the other hand, if uniformity of tension in the web is not crucial in the design of the tracking apparatus, a tracking apparatus comprising two laterally constraining supports, at least one of which is a P support in conformance with the stability principle outlined above, will provide a laterally stable web tracking apparatus. A measure of uniformity of tension in the web will be maintained if manufacturing and mounting tolerances are kept at a minimum, notwithstanding the violation of the "once and only once" principle outlined above. In such an apparatus, gimballing the two supports would not provide the necessary gimballing action since the wrap angle of one or both laterally constraining supports would be about 180°.

The introduction of additional supports to a closed loop web tracking apparatus, however, eliminates the technical and practical problems discussed above if the combination of supports conforms to two tracking principles outlined above, and their location relative to each other is such that the respective wrap angles the moving web makes with the three or more supports are within the limits previously discussed.

It is clear from the preceding discussion that a P support is a crucial element of a web tracking apparatus that is to conform to the web tracking principles stated above. The art discloses a variety of P supports which, for convenience, will be termed "active" P supports to differentiate them from the subject matter of the present invention, which discloses a "passive" P support. The differentiation of the two categories of P supports centers around the mechanical means employed by the respective P supports to laterally constrain the entering web portion against changing its lateral spatial position. In the passive P support of the instant invention lateral stability is achieved by edge guides mounted on a fixed frame independent of the web engaging surface of the P support. On the other hand, active P supports disclosed by the art includes servo controlled steering rollers in which lateral position of the moving web is maintained by an external mechanism which senses the misalignment of the moving web and triggers a compensating mechanism to return the moving web to its aligned position. The external sensing mechanism can be mechanical, electrical, or pneumatic and generally has the disadvantage of being complex and expensive. There is also the added practical disadvantage of lateral web oscillation between the aligned and the sensed misaligned position.

Accordingly, it an object of the invention to provide a passive web support for constraining the lateral spatial position of the moving web which is mechanically simple and reliable, and independent of external sensing mechanisms.

It is another object of the invention to provide a passive web support for constraining the lateral spatial position of the entering web and for angularly decoupling the exiting web, which is independent of external sensing mechanisms.

SUMMARY OF THE INVENTION

These objects are accomplished by the present invention by providing a web support in which the entering portion of the moving web is constrained against changing its lateral spatial position while remaining free to change its angular lateral position. The web support includes a surface which rotates in engagement with the web without offering substantial lateral resistance to the moving web, and opposed edge guides mounted in a predetermined position on a fixed frame independently of and adjacent to the web engaging surface of the web support. The edge guides have opposed web engaging portions a fixed distance apart corresponding substantially to the width of the moving web.

In the preferred embodiment of the invention the web engaging surface includes a cylindrical roller mounted for rotational movement about a longitudinal axis which passes through the midpoint of the roller, and pivotal movement about a castering axis to enable the roller to align itself to the entering web, thereby presenting no lateral resistance to the entering web. The castering axis is substantially perpendicular to and intersects a plane substantially parallel to the entering web at a point upstream from the midpoint of the roller. The opposed web engaging portions of the edge guides include a pair of opposing flanges mounted adjacent to opposite ends of the roller for rotational and axial movement independent of the rotational movement of the roller. The fixed distance apart of the flanges is maintained by members cantilevered from a fixed frame which have rotating wheels at the free ends in rotational contact with the flanges, the rotation of the wheels and the flanges being in perpendicular planes.

To angularly decouple the moving web exiting from the web support, the roller in the preferred embodiment is mounted for pivotal movement about a gimbal axis which is parallel to the plane of the entering web and which is perpendicular to and intersects the longitudinal axis of the roller at its midpoint.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings in which:

FIG. 1 is an isometric view of a passive laterally constraining web support in accordance with the present invention showing the relative location of the various axes, and the direction of movement of the web;

FIG. 2 is a side view of the web support shown in FIG. 1;

DESCRIPTION OF THE PREFERRED EMBODIMENT

Figure 3:
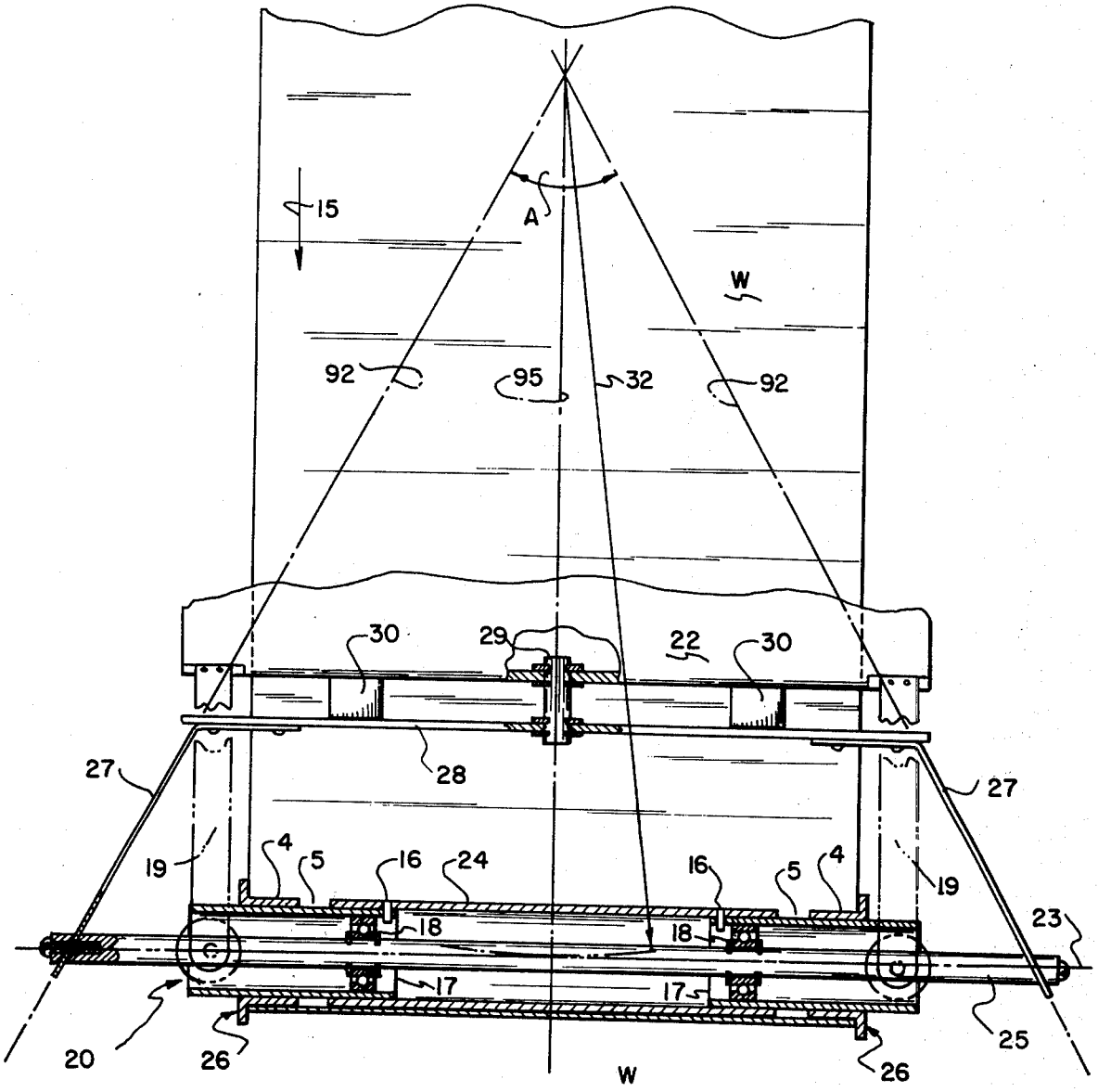
FIG. 3 is a cross-sectional view of the web support of the invention showing the inner sleeve upon which the web engaging portions of the edge guides are free to rotate and translate.

Referring now to the drawings wherein like reference numerals have been used in the several views and figures for like elements, FIG. 1 illustrates a passive, laterally constraining web support 20 including a cylindrical roller 24 journalled by ball bearings 18 on a shaft 25. The shaft is attached through flexture members 27 to a pivoting bar 28, which is mounted to fixed frame 22 through pivot 29 and is supported by anti-friction pads 30, thereby enabling roller 24 to pivot about gimbal axis 95. Flexture members 27 are relatively thin plates designed to flex in a direction parallel to longitudinal axis 23 in response to a lateral force, while remaining rigid in the plane of the plate, and are mounted so that their respective centerlines (lines of action 92) intersect gimbal axis 95 when the web support is in the nominal postion; i.e., under no-load condition. Hence, flexture members 27 enable roller 24 to pivot about castering axis 90, defined by the intersection of lines of action 92, and which is perpendicular to the plane formed by said lines of action. The magnitude of castering radius 32 (see FIG. 3), which is a function of the angle A formed by the intersecting lines of action of flexture members 92, will depend on design consideration of the tracking apparatus. For example, the lateral displacement of roller 24 in response to a lateral force will be greater for a longer radius than for a shorter one, making the longer castering radius more sensitive to lateral forces.

Turning now to FIG. 3 it is seen that cylindrical roller 24 has attached to each end inner sleeves 17 which extend beyond the ends of the roller. Floating flanges 26 are mounted on sleeves 17 for independent axial and rotational movement from roller 24 and have web engaging cylindrical portions 4 of the same outside diameter as roller 24.

The maximum inside distance between flanges 26 is kept constant by limiting wheels 21 which are rotationally mounted on cantilevered members 19 fixedly attached to frame 22. The peripheries of limiting wheels 21 are in contact with the outside edges of floating flanges 26 and reduce the friction between rotating wheels 21 and rotating flanges 26. The distance from longitudinal axis 23 at which limiting wheels 21 contact flanges 26 determines the amount of friction which is generated. Clearly, the farther from the longitudinal axis 23 the point of contact occurs (without, of course, going off the edge) the less friction is generated. With this in mind, the location of the point of contact may be determined by design considerations.

In an apparatus incorporating the preferred embodiment of the invention illustrated in FIGS. 1–4, the surface of roller 24 is polished aluminum, the web in contact with roller 24 is polyethelyne terephthalate and has a thickness in the order of seven mils, and the wrap angle web W makes with roller 24 is in the order of 120°.

In operation, the unidirectional character of the web support of the present invention determines the orientation of the web support on a web tracking apparatus. That is, the gimbal axis of the web support is substantially parallel to the plane of the entering web portion to enable the web engaging surface of the web support to pivot about the gimbal axis without affecting the perpendicularity of the direction of travel of the entering web portion and the longitudinal axis of the roller. Otherwise, due to the phenomenon of tracking, pivotal movement of the web engaging surface about the gimbal axis would affect the upstream web portion. Similarly, the castering axis intersects the plane of the entering web at an upstream location, as opposed to a downstream location. Otherwise, the web engaging surface would become laterally unstable.

Figure 4:
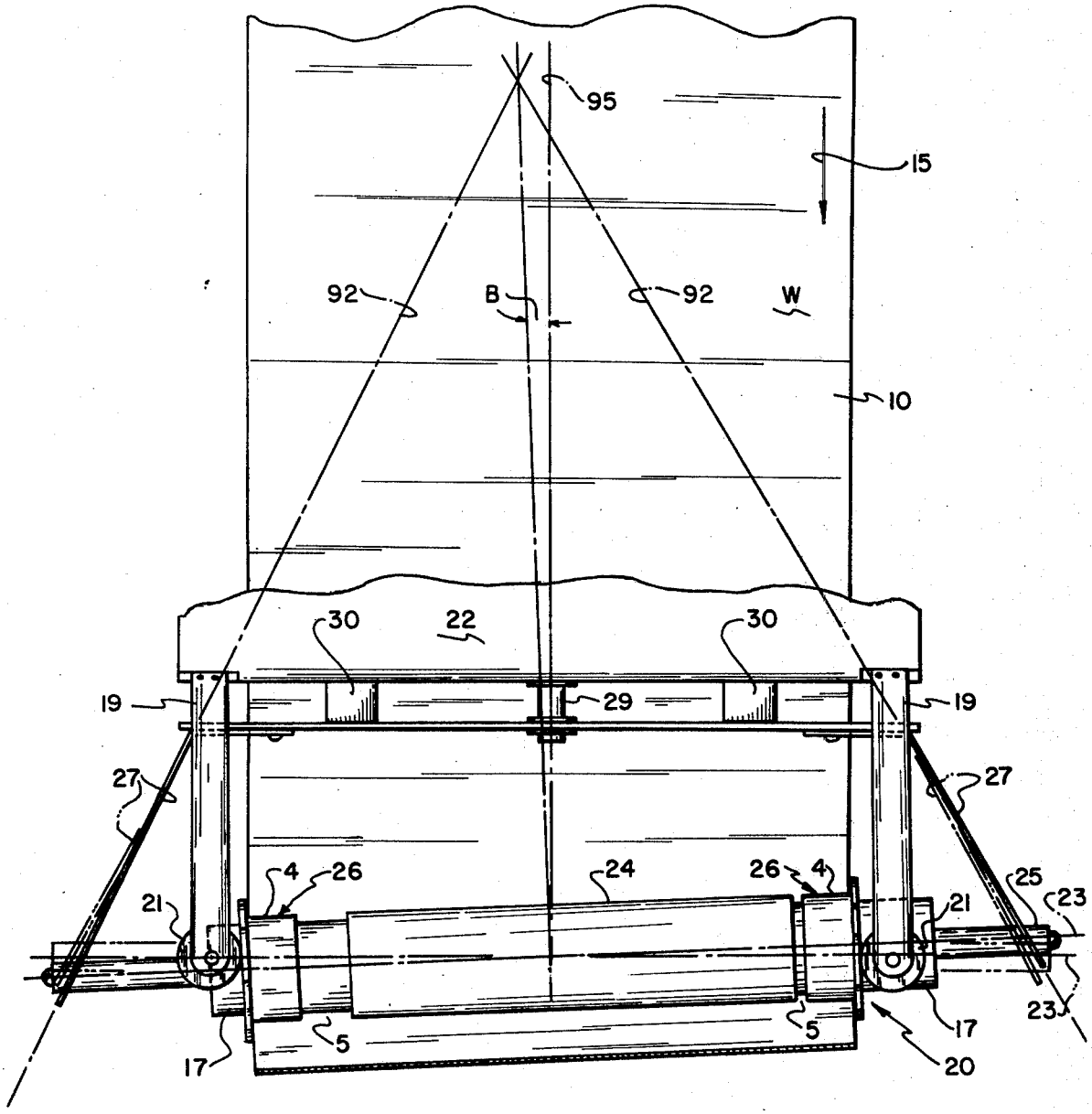
FIG. 4 is a plan view of the web support of the invention showing in phantom the nominal position of the shaft which rotatably supports the roller, and the relative shift in position of the shaft and web engaging roller in response to an angular change in the entering web while the position of the opposed edge guide remains fixed relative to the frame.

Referring now to FIGS. 1 and 4 it is seen that the plane of entering portion 10 of the moving web W moving in the direction indicated by arrow 15 is parallel to the plane formed by intersecting lines of action 92, which, for convenience, will be referred to as the entrance plane. In keeping with the web tracking principles discussed previously, entering web portion 10 of moving web W angularly decoupled from an upstream laterally constraining web support from which it exits to meet web support 20 without creating non uniformity of tension in entering web portion 10. That is, if the midpoint of web support 20 is not in the same plane as the midpoints of other web supports in the tracking apparatus, entering web portion 10 must be free to change its angular direction to meet web support 20 at the angle it is mounted on a fixed frame without creating non uniformity of tension in the web span.

Upon engaging entering web portion 10, roller 24 does not laterally constrain (either positionally or angularly) the entering web since roller 24 is free to pivot about castering axis 90, thereby enabling the roller to align itself to the entering web so that its axis of rotation 23 is perpendicular to the direction of entering web portion 10 as indicated by arrow 15. This castering action of web support 20 is more clearly seen in FIG. 4 where the phantom lines indicate the nominal position of shaft 25 (and, of course, roller 24) and the solid lines show the position assumed by roller 24 to accommodate the angular change (angle B in FIG. 4) of entering web portion 10. It is seen that roller 24, through the phenomenon of tracking, has pivoted about its castering axis so that its axis of rotation 23 remains perpendicular to the direction of travel of web W as indicated by arrow 15.

The inclusion of floating flanges 26 to the web support, in which the maximum separation is held constant relative to frame 22 by limiting wheels 21, transforms the otherwise non constraining web support to a P support; i.e., a positional constraint which constrains the entering web against changing its lateral spatial position while remaining free to change its angular position. The inside distance between flanges 26 corresponds substantially to the width of the web W. As seen in FIGS. 3 and 4, there is an equidistant separation 5, when the web support is in nominal position, between the ends of roller 24 and web engaging portions 4 of flanges 26 to enable lateral displacement of roller 24 due to pivotal movement about castering axis 90. During such displacement, e.g., as shown in FIG. 4, where the separation is greater at one side, the relative positions of flanges 26 remain fixed since the flanges are mounted for axial movement on sleeves 17. It is noted that the mounting of flanges 26 on sleeves 17 enables the web engaging portions 4 to rotate with moving web W with nominal frictional or mechanical resistance. In essence, web engaging portions 4 become part of roller 24.

The lateral displacement of roller 24 shown in FIG. 4, due to pivotal movement about the castering axis, is exaggerated for clarity. Ordinarily, the web supports on a web tracking apparatus are mounted with their midpoints substantially in the same plane and their horizontal axes substantially in parallel, to within tolerance established by the design of the apparatus. It is a feature of the invention, however, to compensate for imprecise tolerances of the web tracking apparatus.

From the foregoing, it is seen that for small pivotal movement of roller 24 about castering axis 90, the lateral spatial position of the web at roller 24 remains fixed even though the angle of the entering web may change. The slight change in angle of the nominal position of flanges 26 from their position due to pivotal movement of roller 24 about castering axis 90 does not appreciably change the inside distance between the flanges. Hence, flanges 26 provide lateral positional stability for moving web W. Moreover, since roller 24 offers substantially no lateral resistance to entering web portion 10, no excess forces develop on the edges of web W and, therefore, no edge damage can occur as long as the angle of entering web portion 10 is within the tolerances of the castering action of the roller.

Upon engagement of entering web portion 10 with roller 24, moving web W becomes fully constrained insofar as exiting portion 12 is concerned. That is, without more, exiting web portion 12 would not be free to change its angular direction; and since the lateral spatial position of moving web W is fixed at roller 24, the exiting web becomes fully constrained and incapable of adjusting to downstream conditions. This situation does not affect the stability principle of web tracking. However, it does affect the uniformity of tension principle. To ensure compliance of exiting web portion 12 with this latter principle, roller 24 is mounted for pivotal movement about gimbal axis 95.

Referring to FIGS. 1 and 3, gimbal axis 95 is perpendicular to and intersects longitudinal axis 23 at the midpoint of roller 24 and lies in the entrance plane defined by intersecting lines of action 92. As noted previously, the plane of entering portion 10 s parallel to the entrance plane. Thus, exiting web portion 12 is free to change its angular direction without affecting the perpendicularity of the direction of travel of moving web W as indicated by arrow 15, and longitudinal axis 23. This feature of the invention angularly decouples exiting web portion 12, thereby enabling it to adjust to downstream conditions while promoting uniformity of tension in the exiting web. As with the castering action of roller 24, the magnitude of the movement about gimbal axis 95 of roller 24 is a function of the design of the web tracking apparatus and should be such as to enable exiting web portion 12 to change its angular direction to meet the downstream web support. Ordinarily, this magnitude does not appreciably change the inside distance between flanges 26.

It should be noted that the significant features of web support 20 are the opposed edge guides, mounted in a predetermined position on a fixed frame adjacent to the web engaging surface of the web support, which are a fixed distance apart corresponding to the width of the web, and a web engaging surface which present substantially no resistance to the entering web. Clearly, there are numerous ways contemplated by the invention by which these features can be achieved. For example, rather than a castered roller such as 24, an axially compliant roller could be utilized since such a roller would present no lateral resistance to entering web portion 10. Similarly, flanges or other types of edge guides could be fixed relative to a fixed frame in numerous ways.

The invention has been described in detail with particular reference to preferred embodiments thereof, but it will be understood that variations and modifications can be affected within the spirit and scope of the invention.

We claim:

1. A web support mounted on a fixed frame for rotation in engagement with a moving web, the web defining an entering web portion relative to said web support and a closed path of movement, said web support comprising:

a. edge guide means mounted in a predetermined location in the path of movement, said edge guide means having opposed web engaging portions a fixed maximum distance apart which distance corresponds substantially to the width of the moving web for establishing at said edge guide means a fixed lateral spatial position of the web relative to the frame; and b. means defining a web supporting surface at the predetermined location for rotating in tracking engagement with the moving web, said surface-defining means presenting negligible resistance to changes in the lateral angular position of the entering web portion;

said web support laterally constraining the entering web portion against change in its spatial position while permitting freedom of the entering web portion to change its angular position.

2. A web support mounted on a fixed frame, the web defining a path of movement and an entering web portion relative to said web support, said web support comprising:

means for constraining the web in a fixed lateral spatial position relative to the frame at a first location in the path of movement of the web, said constraining means offering substantially no support and substantially no lateral angular constraint to the moving web; and means defining a web supporting surface at the first location, said surface defining means being mounted to rotate in tracking engagement with the web without imposing lateral forces on the web regardless of the lateral angular position of the web relative to the frame.

3. A web support mounted on a fixed frame for engagement with a moving web, the web having an entering web portion relative to said web support which entering web portion may have an imprecisely known angular direction of movement, said web support comprising:

edge guide means having opposed web engaging portions a fixed maximum distance apart which distance corresponds substantially to the width of the moving web for establishing at said edge guide means a fixed lateral spatial position of the web relative to the frame; and means defining a web supporting surface laterally between said opposed web engaging portions for rotating in tracking engagement with the moving web, said rotation of said surface-defining means imposing no more than negligible lateral forces between the web and said web engaging portions regardless of the angular direction in which the web is moving between said opposed web engaging portions.

4. A web support mounted on a fixed frame for rotation in engagement with a moving web, the web defining an entering web portion relative to said web support, said web support comprising:

means for constraining the web in a fixed lateral spatial position relative to the frame at a first location in the path of movement of the web, said constraining means offering no substantial support to the moving web and negligible resistance to changes in the lateral angular position of the moving web at said constraining means; and a cylindrical roller for rotating with the web and defining an area for engaging and supporting the web at the first location, said area being displaceable axially without gross slipping relative to the web to relieve lateral forces resulting from the angular direction of movement of the web at the first location.

5. A web support mounted on a fixed frame for engaging a moving web, the web defining an entering web portion relative to said web support and having a longitudinal direction of movement, said web support comprising:

a. edge guide means having opposed web engaging portions a fixed maximum distance apart which distance corresponds substantially to the width of the moving web for establishing at said edge guide means a fixed spatial lateral position of the web relative to the frame; and b. means defining a surface for rotating in tracking engagement with the moving web, said surface-defining means having a desired aligned relationship relative to the entering web portion in which said surface is perpendicular to the longitudinal direction of movement, said surface defining means being mounted to change its lateral angular relationship relative to the entering web portion to relieve any substantial lateral forces between the web and said edge guide means by aligning itself in the desired relationship to the entering web portion.

6. A web support mounted on a fixed frame for rotation in engagement with a moving web, the web having an entering web portion, said web support comprising:

a. a cylindrical roller having a longitudinal axis and a castering axis, said roller being mounted for rotational movement about said longitudinal axis to engage and support the moving web without substantial slipping and for pivotal movement about said castering axis to align itself to the entering web portion without presenting substantial lateral resistance to the entering web portion; and b. means adjacent to said surface defining means for constraining the web in a fixed lateral spatial position relative to the frame, said constraining means offering no more than negligible support and no more than negligible lateral angular constraint to the moving web;

whereby said web support constrains the entering web portion against change in its lateral spatial position while permitting freedom of the entering web portion to change its lateral angular position.

7. A web support mounted on a fixed frame, the web having an entering web portion and an exiting web portion relative to said web support, said web support comprising:

a. a cylindrical roller having a longitudinal axis, a castering axis and a gimbal axis, said cylindrical roller being mounted for rotational movement about said longitudinal axis to engage the moving web without substantial slipping, for pivotal movement about said castering axis to align itself to the entering web portion with negligible resistance, and for pivotal movement about said gimbal axis to angularly decouple the exiting web portion and provide uniformity of tension in the exiting web portion; and b. edge guide means mounted in position adjacent to said surface-defining means, said edge guide means having opposed web engaging portions a fixed distance apart which corresponds substantially to the width of the moving web for establishing at said edge guide means a fixed lateral spatial position of the web relative to the frame.

8. A web support mounted on a fixed frame for rotation in engagement with a moving web, the web having an entering web portion and an exiting web portion relative to said web support, said web support comprising:

a. a cylindrical roller having a longitudinal axis and a castering axis, said cylindrical roller being mounted for rotational movement about said longitudinal axis to engage the moving web without substantial slipping and for pivotal movement about said castering axis to align itself with negligible resistance to the entering web portion; and b. edge guide means mounted in position adjacent to said surface-defining means, said edge guide means including a pair of opposed web engaging flanges a fixed maximum distance apart which corresponds substantially to the width of the moving web for establishing at said edge guide means a fixed spatial lateral position of the web relative to the frame, said flanges being mounted adjacent to opposite ends of said cylindrical roller for axial movement independent of said rotational and pivotal movement of said cylindrical roller.

9. A web support mounted on a fixed frame for rotation in engagement with a moving web, the web having an entering web portion and an exiting web portion relative to said web support, said web support comprising:

a. a cylindrical roller having a longitudinal axis and a castering axis, said cylindrical roller being mounted for rotational movement about said longitudinal axis to engage the moving web without substantial slipping and for pivotal movement about said castering axis to align itself to the entering web portion without substantial resistance to lateral movement of the entering web portion; and b. edge guide means mounted in position adjacent to said cylindrical roller, said edge guide means having a pair of opposed web engaging flanges having a fixed maximum distance apart which corresponds substantially to the width of the moving web for establishing at said edge guide means a fixed lateral spatial position of the web relative to the frame, said flanges being mounted adjacent to opposite ends of said cylindrical roller for rotational and axial movement independent of said rotational and pivotal movement of said cylindrical roller, said edge guide means including a pair of members cantilevered from said fixed frame to maintain constant the maximum separation of said flanges and the spatial lateral position of the web, said members having wheels mounted for rotational movement in contact with said flanges to reduce frictional forces developed at said point of contact, the rotational movement of said flanges and said wheels being in perpendicular planes.

* * * * *